US006155477A

United States Patent [19]

Herrera et al.

[11] Patent Number: 6,155,477

[45] Date of Patent: Dec. 5, 2000

[54] CONVERTIBLE BOX

[75] Inventors: Richard Jay Herrera, Chandler; Tim Tunnell, Phoenix, both of Ariz.

[73] Assignee: U-Haul International, Inc., Phoenix, Ariz.

[21] Appl. No.: 09/199,651

[22] Filed: Nov. 25, 1998

[51] Int. Cl.[7] ..... B65D 5/54

[52] U.S. Cl. ..... 229/103; 229/101; 229/103.3; 229/116.1; 229/120.011

[58] Field of Search ..... 229/101, 101.2, 229/103.3, 120.011, 103, 116.1, 178, 190

[56] References Cited

U.S. PATENT DOCUMENTS

| | | | |
|---|---|---|---|
| 1,772,625 | 8/1930 | Caulfield | 229/152 |
| 1,856,282 | 5/1932 | Holy | 229/178 |
| 3,167,240 | 1/1965 | Collura et al. | 229/101.2 |
| 3,190,532 | 6/1965 | Marsh | 229/156 |
| 3,310,220 | 3/1967 | Feldman | 229/101 |
| 3,727,827 | 4/1973 | Stice . | |
| 3,728,002 | 4/1973 | Zacks | 229/178 |
| 3,853,259 | 12/1974 | Tupper | 229/103 |
| 4,136,817 | 1/1979 | Perry . | |
| 4,235,364 | 11/1980 | Baker . | |
| 4,452,367 | 6/1984 | Wein . | |
| 4,511,079 | 4/1985 | Lopez . | |
| 4,535,928 | 8/1985 | Capo . | |
| 4,735,356 | 4/1988 | Engel | 229/103 |
| 4,763,831 | 8/1988 | Huang et al. | 229/101 |
| 5,060,849 | 10/1991 | King | 229/101 |
| 5,071,062 | 12/1991 | Bradley et al. | 229/109 |
| 5,110,038 | 5/1992 | Pantisano et al. | 229/103 |
| 5,148,940 | 9/1992 | Mendise . | |
| 5,358,172 | 10/1994 | Hollander et al. | 229/103 |
| 5,601,230 | 2/1997 | Bell | 229/103 |
| 5,645,212 | 7/1997 | Potter | 229/101 |

FOREIGN PATENT DOCUMENTS

| | | | |
|---|---|---|---|
| 2584049 | 1/1987 | France | 229/101 |
| 406051 | 7/1966 | Switzerland | 229/116.1 |
| 2209152 | 5/1989 | United Kingdom | 229/101.2 |

*Primary Examiner*—Gary E. Elkins
*Attorney, Agent, or Firm*—Jeffer, Mangels, Butler & Marmaro LLP

[57] ABSTRACT

A blank for forming a plurality of containers includes a sheet of material having a plurality of edges and first and second pluralities of score lines. The first plurality of score lines, together with the edges, define a first plurality of panels. The blank is foldable along the first plurality of score lines to define a primary container. The second plurality of score lines are defined within at least one of the first plurality of panels. The at least one panel is detachable from the remainder of the blank, and is foldable along the second plurality of score lines to define a secondary container.

6 Claims, 8 Drawing Sheets

CONVERTIBLE BOX

FIELD OF THE INVENTION

The present invention relates to blanks for containers made of a sheet material such as corrugated paper, cardboard, plastic, etc.

BACKGROUND OF THE INVENTION

Container blanks useful for forming a variety of different sized containers are known. For example, Baker, U.S. Pat. No. 4,235,364, discloses a pair of container blanks scored and perforated in a manner that allows each blank to be formed into a number of different sized containers, and that also allows the two blanks to form telescoping containers. Stice, U.S. Pat. No. 3,727,827, teaches a variable size container blank having a plurality of transverse parallel score lines and another plurality of parallel longitudinal score lines, together with slots and perforations. Folding the blank along various of the transverse and longitudinal score lines yields containers having a range of sizes. Other variable size blanks are disclosed by Perry, U.S. Pat. No. 4,136,817, and Wein, U.S. Pat. No. 4,452,367.

Dual-purpose blanks useful for sequentially forming two differently sized containers are also known. For example, King, U.S. Pat. No. 5,060,849, describes a blank which can be folded to form a shipping carton, and subsequently refolded, with removal of certain portions, to form an open-top tray.

A need exists for a new type of container blank which can be folded into an initial container configuration, used to package a first object or set of objects, and then re-formed into two or more separate containers of varying sizes for subsequent packaging of additional items.

SUMMARY OF THE PREFERRED EMBODIMENTS

In accordance with one aspect of the present invention, there is provided a blank for forming a plurality of containers includes a sheet of material having a plurality of edges and first and second pluralities of score lines. The first plurality of score lines, together with the edges, define a first plurality of panels. The blank is foldable along the first plurality of score lines to define a primary container. The second plurality of score lines are defined within at least one of the first plurality of panels. The at least one panel is detachable from the remainder of the blank, and is foldable along the second plurality of score lines to define a secondary container.

In a preferred embodiment, the blank comprises a plurality of detachable panels, and the second plurality of score lines are defined within these detachable panels.

In accordance with another aspect of the present invention, there is provided a blank for forming a plurality of containers comprising a sheet of material having a plurality of edges and first and second pluralities of score lines. The plurality of edges comprise a first plurality of parallel straight edges oriented in a first direction, and a second plurality of parallel straight edges oriented in a second direction that is substantially perpendicular to the first direction. Primary and secondary containers are defined similarly to the preceding embodiment.

In accordance with a further aspect of the present invention; methods of sequentially packaging a plurality of objects are provided. The methods include the steps of producing a primary container as described herein, disposing a first object within the primary container, subsequently removing the first object from the primary container, detaching at least one detachable panel from the blank, producing a secondary container by folding the detachable panel, and disposing a second object within the secondary container.

In accordance with yet another aspect of the present invention, a method of making a blank as described herein is provided. The method includes the steps of providing a sheet of material, defining a plurality of edges of the sheet of material, forming a first plurality of score lines in the sheet of material such that the score lines and edges define a first plurality of panels such that the blank is foldable along the first plurality of score lines to define a primary container, and forming a second plurality of score lines defined within at least one of the first plurality of panels such that the at least one panel, after separation from the remainder of the blank, is foldable along the second plurality of score lines to define a secondary container.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

The present invention provides a container, in particular a box-type container, that can be used for initial packaging of one or more objects, and then, after the initial use, be reformed into multiple other containers of various sizes. The blank can be provided with a variety of score lines, together with optional perforations, adhesive strips for facilitating assembly of the containers, and surface indicia such as assembly instructions and advertising.

Figure 1:
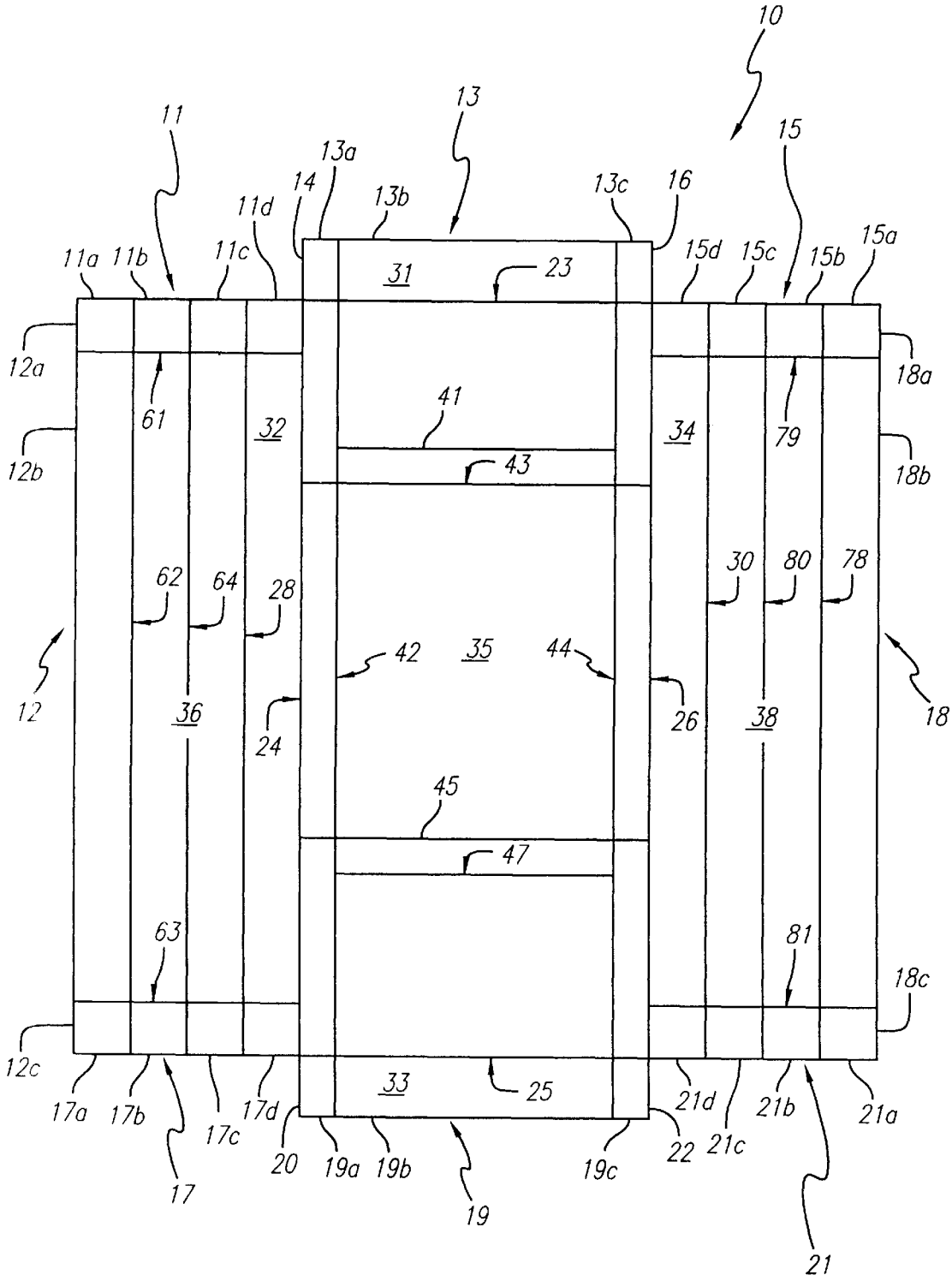
FIG. 1 is a plan view of a first embodiment of a blank according to the invention.

Turning to the figures, in FIG. 1 blank 10 has a plurality of parallel transverse edges 11, 13, 15, 17, 19, and 21, and a plurality of parallel longitudinal edges 12, 14, 16, 18, 20, and 22. Of the latter, edges 14 and 20 are collinear, as are edges 16 and 22. Blank 10 can be formed from a variety of materials, e.g., corrugated paper, cardboard, plastic, etc.

As is customary in most container blanks, the longitudinal edges are perpendicular to the transverse edges. In this description, the terms "transverse" and "longitudinal" are being used arbitrarily and are not necessarily related to the machine direction of the liner or the corrugation.

Blank 10 includes a first plurality of score lines. This first plurality of score lines includes parallel transverse score lines 23 and 25, and parallel longitudinal score lines 24 and 26. Score line 23 is collinear with transverse edges 11 and 15, and score line 25 is collinear with transverse parallel edges 17 and 21. Similarly, longitudinal score line 24 is collinear with longitudinal edges 14 and 20, and longitudinal score line 26 is collinear with longitudinal edges 16 and 22. Two additional parallel longitudinal score lines 28 and 30 are also provided. Score line 28, extending from transverse edge 11 to transverse edge 17, is located parallel to score line 24 and between score line 24 and edge 12. Score line 30 is correspondingly located between score line 26 and edge 18, and extends between transverse edges 15 and 21.

Edges 11–22 and score lines 23, 24, 25, 26, 28, and 30 together define a first plurality of panels. As shown in FIG. 1, the panels are delimited as follows. End panel 31 is bounded by parallel longitudinal edges 14 and 16, transverse edge 13 and transverse score line 23. Side panel 32 is bounded by parallel longitudinal score lines 24 and 28, segment 11*d* of transverse edge 11 and segment 17*d* of transverse parallel edge 17. End panel 33 is bounded by transverse edge 19, parallel longitudinal edges 20 and 22, and transverse score line 25. Side panel 34 is bounded by parallel longitudinal score lines 26 and 30, segment 15*d* of transverse edge 15 and segment 21*d* of transverse edge 21. Bottom panel 35 is bounded by parallel transverse score lines 23 and 25, and parallel longitudinal score lines 24 and 26. Top panel 36 is bounded by longitudinal edge 12, longitudinal score line 28, segments 11*a–c* of transverse edge 11 and segments 17*a–c* of transverse edge 17. Finally, top panel 38 is similarly bounded by longitudinal edge 18, longitudinal score line 30, segments 15*a–c* of transverse edge 15, and segments 21 *a–c* of transverse edge 21.

In accordance with the invention, a second plurality of score lines are defined within at least one of the foregoing plurality of panels defined in blank 10. As shown in FIG. 1, bottom panel 35 has defined therein parallel longitudinal score lines 42 and 44, and parallel transverse score lines 41, 43, 45, and 47. Transverse score lines 41 and 47 extend between longitudinal score lines 42 and 44, while transverse score lines 43 and 45 extend between parallel longitudinal score lines 24 and 26, and thus intersect score lines 42 and 44 defined within panel 35. The points of intersection of parallel longitudinal score lines 42 and 44 with transverse edges 13 and 19, and transverse score lines 23, 43, 45 and 25, divide the foregoing edges and score lines into segments 13*a–c,* 19*a–c,* 23*a–c,* 43*a–c,* 45*a–c* and 25*a–c,* respectively.

In a similar manner, parallel longitudinal score line 62 and 64 are defined within top panel 36. Parallel transverse score lines 61 and 63 are defined within top panel 36 and extend across side panel 32. Parallel longitudinal score lines 62, 64, and 28 divide transverse edge 11, transverse score line 61 and 63, and transverse edge 17, into segments 11*a–d,* 61*a–d,* 63*a–d* and 17*a–d*. Transverse score lines 61 and 63, together with transverse score lines 23, 43, 45 and 25, also divide longitudinal score line 24 into segments 24*a–e*.

In a similar manner, parallel transverse score line 79 and 81, and parallel longitudinal score line 78 and 80, are defined within top panel 38 and side panel 34. Parallel longitudinal score lines 78 and 80 together with longitudinal score line 30 divide transverse edges 15 and 21 into segments 15*a–d,* 21*a–d,* and similarly divide transverse score lines 79 and 81 into segments (not labeled).

Figure 2:
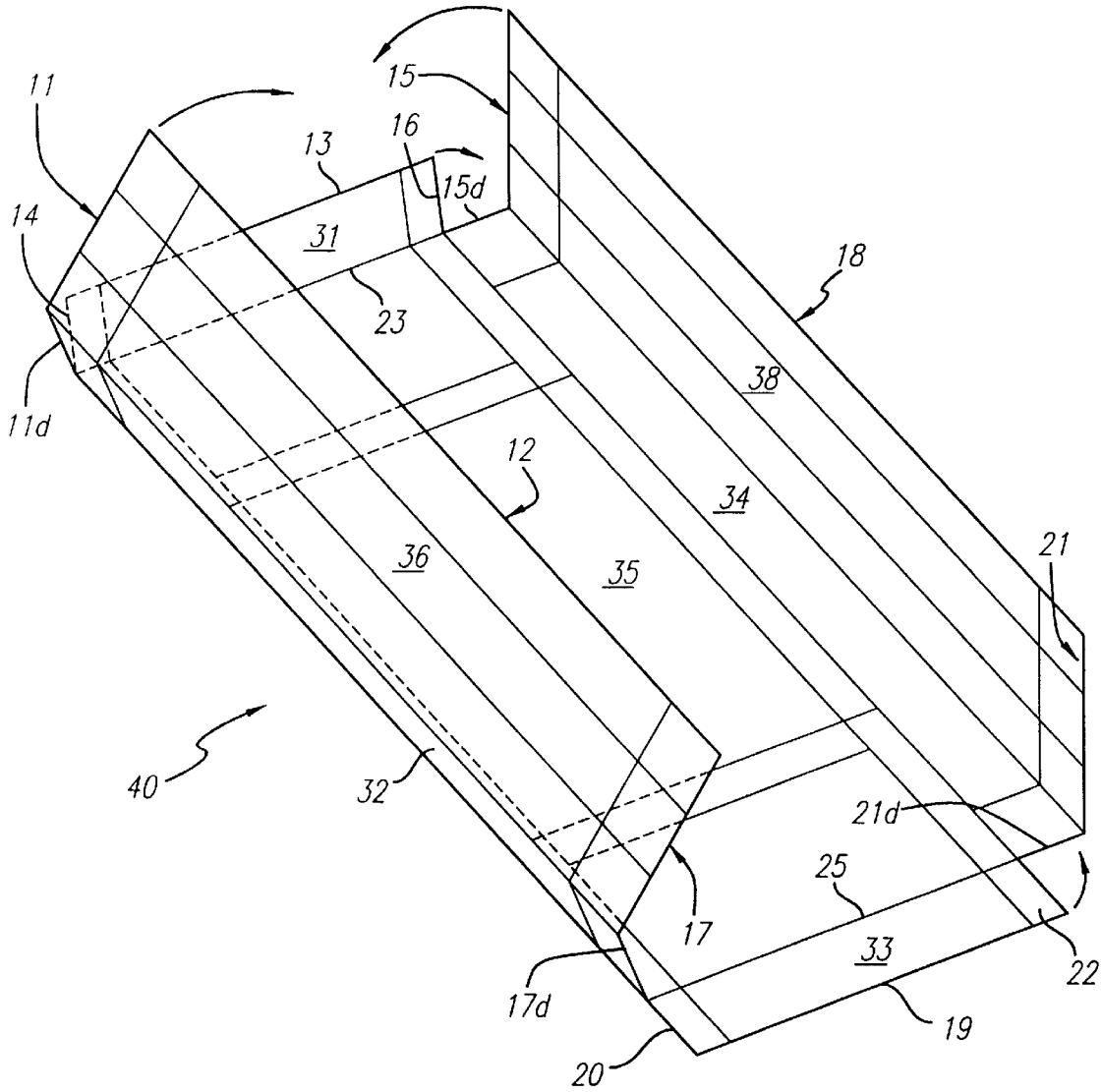
FIG. 2 is an isometric view of a flat, rectangular primary container formed from the blank of FIG. 1, with the arrows indicating the direction of folding of the various panels defining the primary container.

FIG. 2 illustrates the folding of the various panels defined in blank 10 to form primary container 40. End panels 31 and 33 are folded upwards and inwards along score lines 23 and 25, respectively, towards bottom panel 35. Side panels 32 and 34 similarly folded upwards and inwards along score lines 24 and 26, respectively. Top panels 36 and 38 are folded inward along respective score lines 28 and 30. Primary container 40 is formed when the following edges are brought into contact: longitudinal edges 12 and 18; longitudinal edge 14 and segment 11*d* of transverse edge 11; longitudinal edge 16 and segment 15*d* of transverse edge 15; longitudinal edge 20 and segment 17*d* of transverse edge 17; longitudinal edge 22 and segment 21*d* of transverse edge 21; segments 11*a–c* of edge 11 and segments 15*a–c* of edge 15 with transverse edge 13; and segments 17*a–c* of edge 17 and 21*a–c* of edge 21 with transverse edge 19. The edges can then be sealed using conventional means such as adhesive tape, in order to secure one or more items to be packaged within primary container 40.

Figure 3:
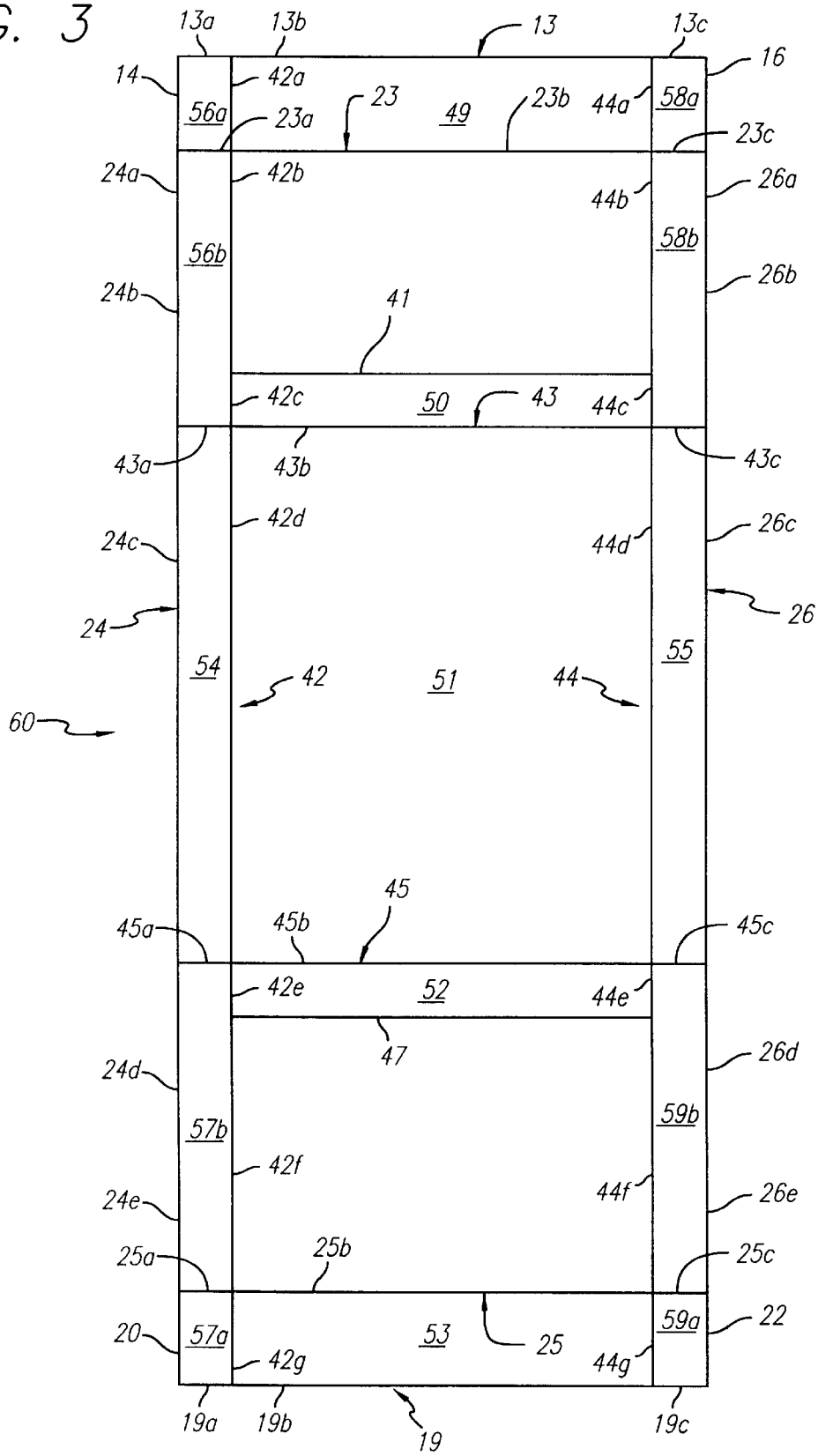
FIG. 3 is a plan view of a portion of the blank of FIG. 1 in which a flat, rectangular first secondary container is defined.
Figures 4, 6:
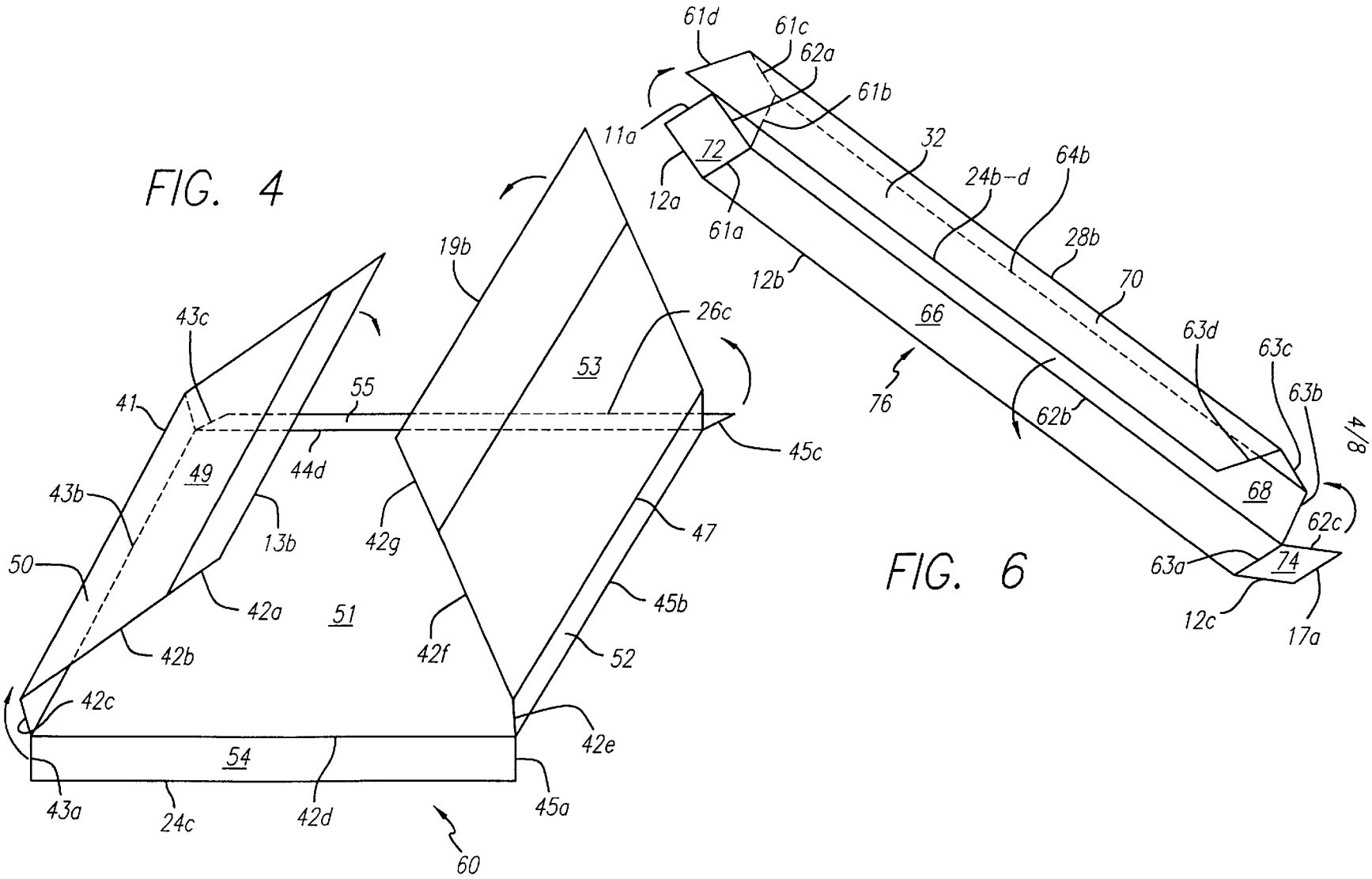
FIG. 4 is an isometric view of the first secondary container formed from the portion shown in FIG. 3.
FIG. 6 is an isometric view of the second secondary container formed from the portion shown in FIG. 5.

In the foregoing embodiment, no portions of the various panels overlap, but rather all panels meet edge to edge. If desired, various of the panels defined in blank 10 can be sized such that two or more panels overlap, or such that one or more overlapping portions form tabs (not shown) for facilitating container assembly. FIGS. 3–4 illustrate a first secondary container 60 which is defined within blank 10 in accordance with the present invention. Container 60 is defined by panels 49 through 55. Top panel 49 is bounded by segment 13*b* of transverse edge 13, segments 42*a* and 42*b* of longitudinal score line 42, transverse score line 41, and segments 44*a* and 44*b* of longitudinal score line 44. Top panel 49 thus includes portions of panels 31 and 35 of primary container 10. Similarly, top panel 53 is bounded by segment 19*b* of transverse edge 19, segments 42*f* and 42*g* of longitudinal score line 42, transverse score line 47 and segments 44*f* and 44*g* of longitudinal score line 44. Top panel 53 thus includes portions of panels 33 and 35 of primary container 10. Side panel 50 is defined between transverse score line 41, segments 42*c* and 44*c* of longitudinal score line 42 and 44, respectively, and segment 43*b* of transverse score line 43. Side panel 52 is similarly defined between segment 45*b* of transverse score line 45, segments 42*e* and 44*e* of longitudinal score lines 42 and 44, respectively, and transverse score line 47. End panel 54 is bounded by segment 24*c* of longitudinal score line 24, segments 43*a* and 45*a* of transverse score lines 43 and 45, respectively, and segment 42*d* of longitudinal score line 42. Side panel 55 is bounded in a similar manner by segments 44*d* and 26*c* of longitudinal score lines 44 and 26, respectively, and segments 43*c* and 45*c* of transverse score lines 43 and 45, respectively. Finally, panels 50, 52, 54 and 55 bound bottom panel 51.

Preferably, removable portions 56*a–b,* 57*a–b,* 58*a–b,* and 59*a–b,* are defined between longitudinal score lines 24 and 42, and 44 and 26, as shown in FIG. 3. In a preferred embodiment, one or more of the segments of the various score lines bounding the aforesaid removable portions are perforated in order to facilitate removal of these portions. For example, segments 28*a* and 23*c* of transverse score line 23 can be perforated to facilitate removal of portions 56*a* and 58*a*, respectively.

FIG. 4 illustrates formation of first secondary container 60. First, the portion of blank 10 used to form container 60 is separated from the remaining portions. This is accomplished, for example, by cutting blank 10 along score lines 24 and 26. In a preferred embodiment, score lines 24 and/or 26 are at least partially perforated in order to facilitate this separation. Then, as shown in FIG. 4, side panels 50 and 52 are folded upwards and inwards along score lines 43*b* and 45*b*, respectively. End panels 54 and 55 are folded upwards and inwards toward bottom panel 51 along score lines 42*d* and 44*d*, respectively. Top panels 49 and 53 are folded inwards along score lines 41 and 47, respectively. The edges of the panels that are brought into contact by this folding are then sealed in any desired manner, for example by use of adhesive tape, to secure one or more items within container 60.

Figure 5:
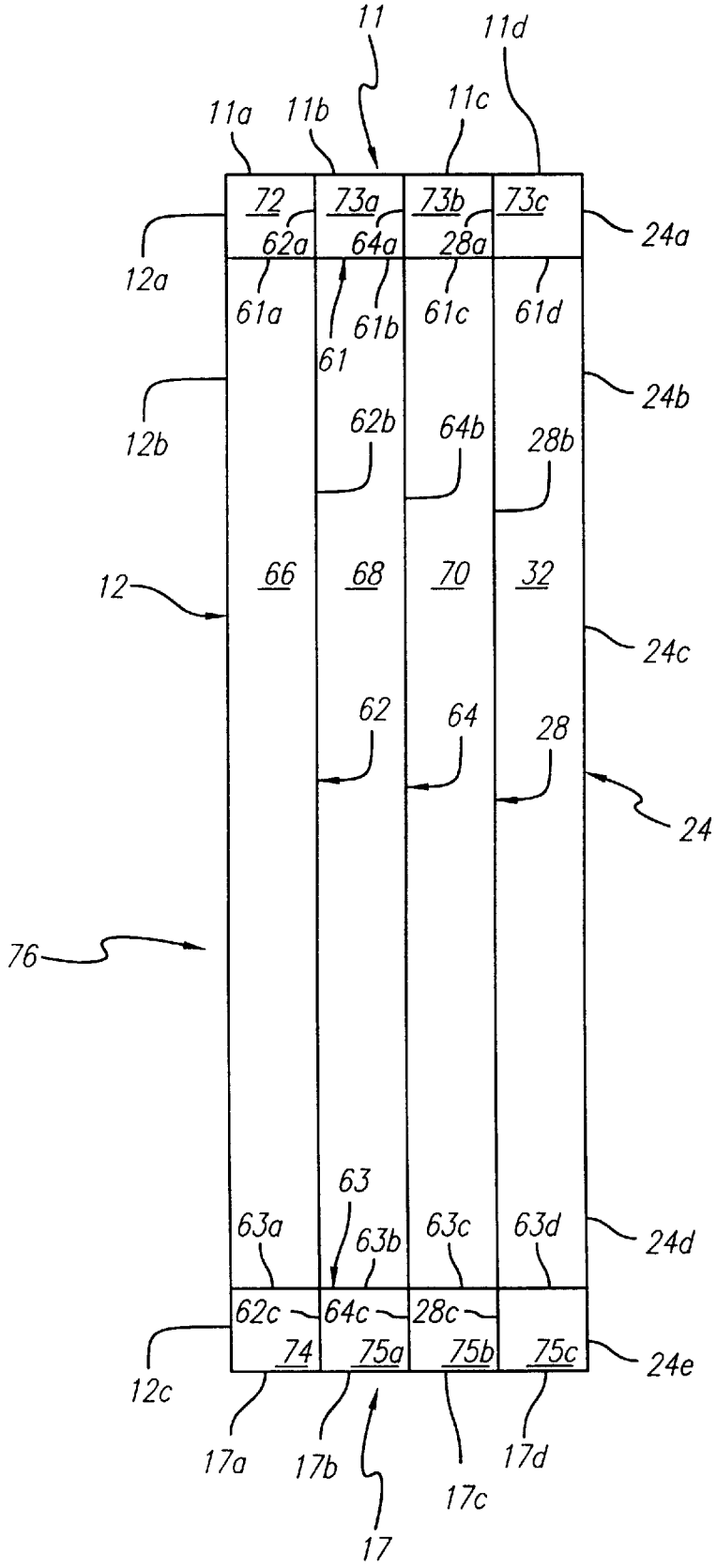
FIG. 5 is a plan view of another portion of the blank of FIG. 1 in which a tubular second secondary container is defined.

FIGS. 5 and 6 illustrate a second secondary container 76 formed from another portion of blank 10 in accordance with the present invention. Longitudinal score lines 62 and 64 divide panel 36 of blank 10 into three panels 66, 68, and 70. These panels have the same dimensions and panel 32 of blank 10. End panels 72 and 74 are bounded by edge segment 12*a* of longitudinal edge 12, segments 11*a* and 17*a* of transverse edges 11 and 17, respectively, and segments 62*a* and 62*c* of longitudinal score line 62. Removable portions 73*a–c*, and 75*a–c*, are similarly defined between the appropriate segments of transverse edge 11 and 17, transverse score lines 61 and 63, and longitudinal score lines 62, 64, and 28 and 24. Optionally, one or more segments defining the aforesaid removable portions can be perforated to facilitate removable thereof.

Again, the portion of blank 10 used to form container 76 is separated from the remainder of blank 10. As shown in FIG. 6, side panels 32, 66, 68 and 70, and end panels 72, and 74, are folded to form second secondary container 76. Panel 68 is folded inward along score line 62*b*. Panel 70 is folded inward along score line 64*b*, panel 32 likewise is folded inward along score line 28*b*, panels 72 and 74 are folded inward toward panel 66 along score line 61*a* and 63*a*, respectively. Second secondary container 76 is thus formed when score line segments 24*b–d* are brought into contact with longitudinal edge segment 12*b*, and the edges of end panel 72 and 74 are similarly brought into contact with the opposing section segments. The secondary container 76 is then sealed using any appropriate means, such as adhesive tape.

A similar secondary container can be produced from panels 34 and 38 of blank 10 and a similar manner, utilizing score lines 78, 80, and transverse score lines 79 and 81.

The foregoing embodiments of second secondary container are tubes or rectangular prisms having a square cross-section, i.e., containers in which side panels 32, 66, 68, and 70 have the same length and width. If desired, other secondary containers having different cross-sections, for example rectangular cross-sections, can be prepared by varying the dimensions of one or more of the panels by which such secondary container is defined. For example, side panels 32 and 68 can be defined such that the widths thereof are greater than the widths of remaining side panels 66 and 70, resulting in a secondary container having a rectangular cross-section.

Figure 7:
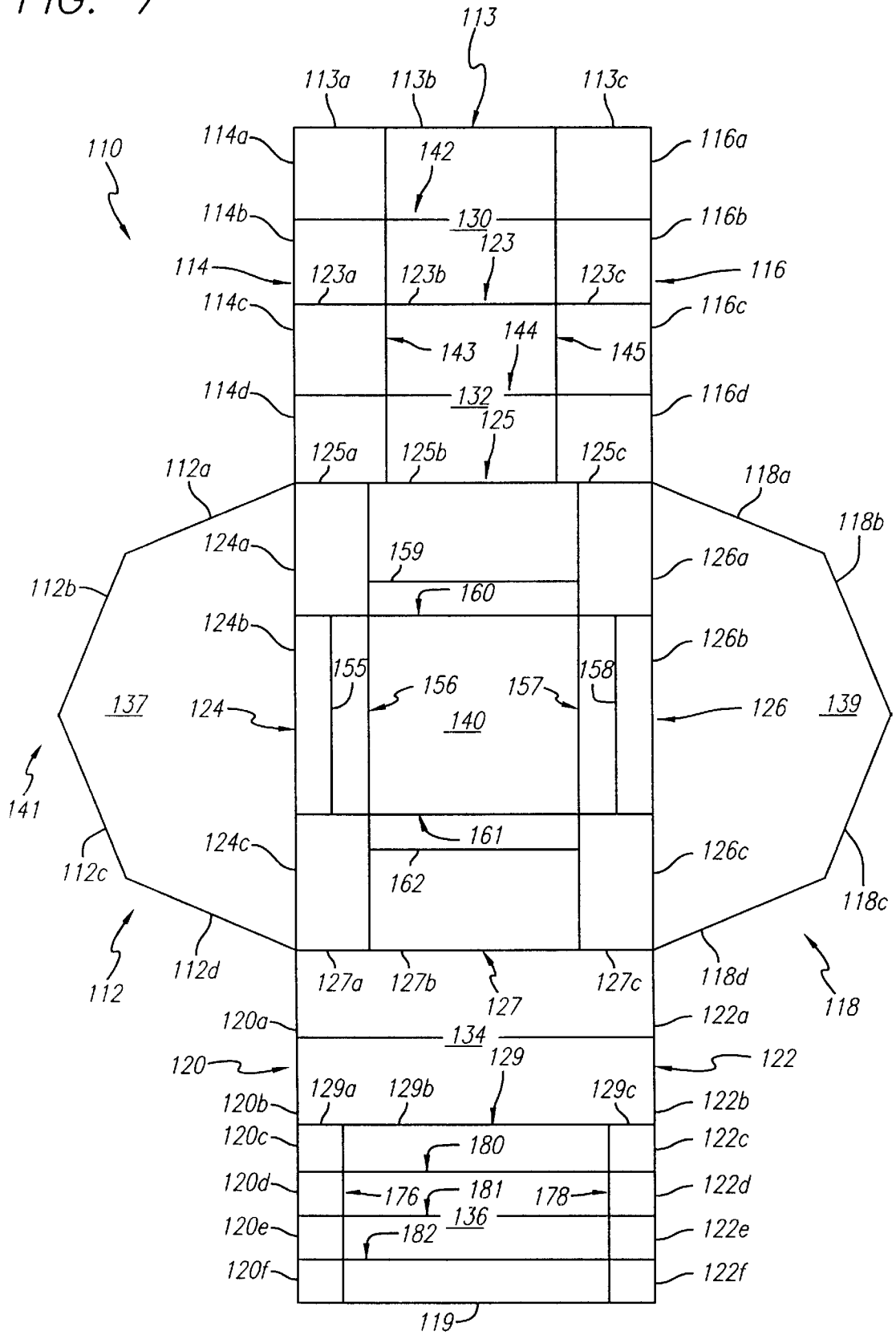
FIG. 7 is a plan view of a second embodiment of a blank according to the invention, for use in preparing a primary container having non-rectangular side panels.

The preceding embodiment illustrates a blank comprised of panels all of which are rectangular. The present invention, however, is not limited to blanks in which all panels are rectangular. FIG. 7 illustrates an alternative embodiment of a blank according to the invention which includes non-rectangular panels. Blank 110 is bounded by lateral edge 112, having non-collinear segments 112*a–d*, longitudinal edges 112 and 118, having non-collinear segments 112*a–d* and 118*a–d*, respectively, longitudinal edges 114, 116, 120, and 122, and transverse edges 113 and 119. Transverse score lines 123, 125, 127, and 129, and longitudinal score lines 124 and 126, together with the foregoing edges, define upper panels 130, 132, 134 and 136, side panels 137, 139, and lower panel 140.

Primary container 141 is formed by folding upper panels 130, 132, 134 and 136, and side panels 137 and 139, in a manner similar to that shown in FIG. 2 with respect to primary container 40 of the proceeding embodiment. Side panels 137 and 139 are folded upward toward lower panel 140, along score lines 124 and 126, respectively. Upper panels 132 and 134 are folded upward and inward toward lower panel 140, along score lines 125 and 127, respectively. Upper panels 130 and 136 are folded inward along score lines 123 and 129, respectively. Once the panels have been folded as described, edge segments 112*a–b* contact edge segments 114*a–d* of edge 114, edge segments 118*a–b* contact edge segments 116*a–d* of edge 116, edge segments 112*c–d* contact edge segments 120*a–f* of edge 120, and edge segments 118*c–d* contact edge segments 122*a–f* of edge 122. Edges 119 and 113 are also brought into contact. The foregoing edges are then sealed using adhesive tape or other desired means in order to secure one or more items within primary container 141.

Figure 8:
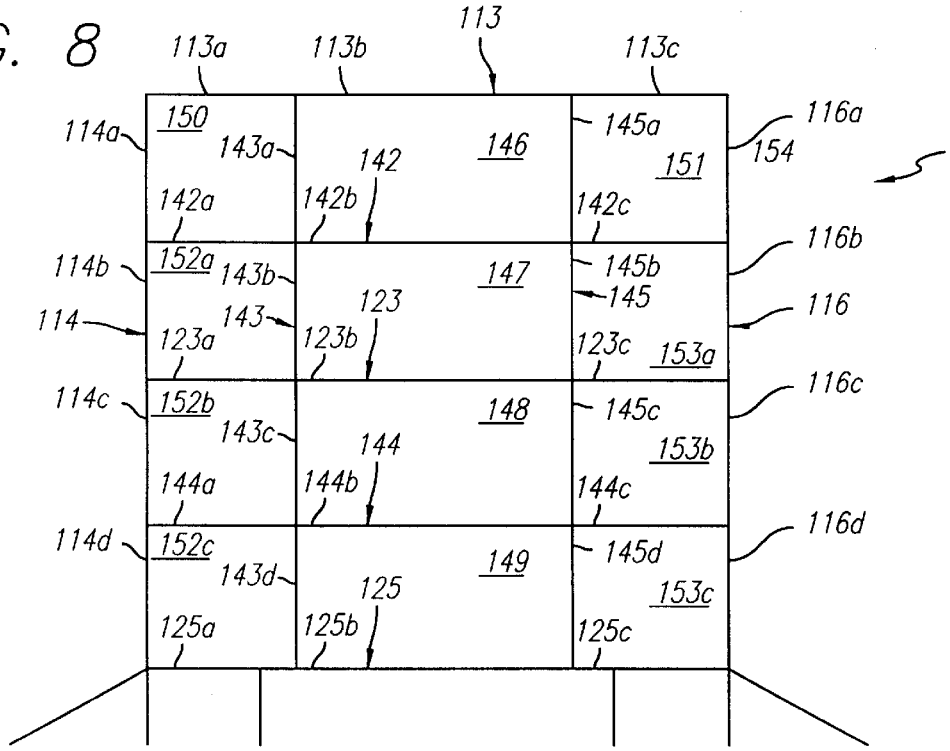
FIG. 8 is a plan view of a portion of the blank of FIG. 7 in which a first secondary container in the form of a larger tube is defined.

A first secondary container 154 formed from a portion of blank 110 is illustrated in FIG. 8. Transverse score line 142 is defined in panel 130 of blank 110, thus dividing upper panel 130 into two panels 146 and 147. Similarly, score line 144 divides upper panel 132 into two panels 148 and 149, Longitudinal score lines 143 and 145 are defined parallel to edges 114 and 116, respectively. Score lines 143 and 145 are divided by transverse score lines 142, 123 and 144 into segments 143*a–d* and 145*a–d*, respectively, and in turn divide the transverse score lines into segments 142*a–c*, 123*a–c*, 144*a–c*, and 125*a–c*, respectively. End panel 150 is defined between edge segments 113*a* and 114 and score line segments 142*a* and 143*a*. Similarly, end panel 151 is defined between edge segments 113*c* and 116*a*, and score lines segments 145*a* and 142*c*. Removable portions 152*a–c* and 153*a–c* are defined between edge 114 and score line 143, and edge 116 and score line 145, respectively, and are separated by score line segments 123*a*, 144*a*, and 123*c* and 124*c*, respectively.

Secondary container 154 is formed by folding panels 146–151 in a manner similar to that shown in FIG. 6 with respect to secondary container 76 of the proceeding embodiment.

Figure 9:
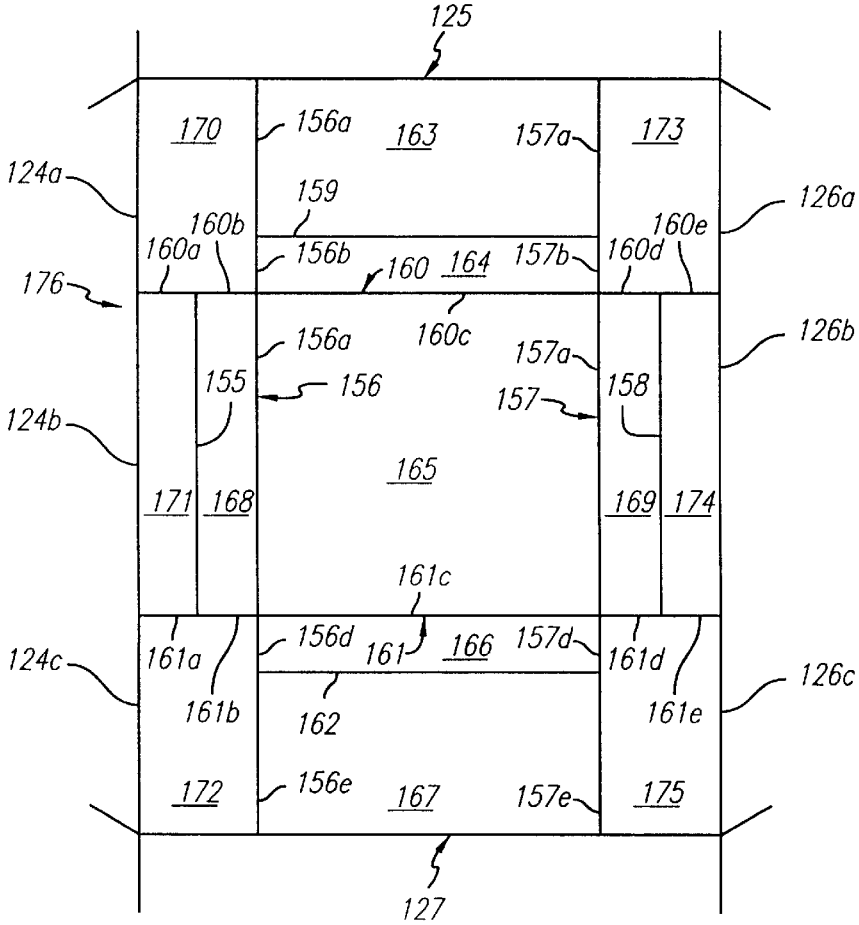
FIG. 9 is a plan view of another portion of the blank of FIG. 7 in which a second secondary contained having a flat rectangular configuration is defined.

In FIG. 9, a second secondary container 176 is defined by means of a plurality of score lines formed within lower panel 140 of blank 110. Transverse score lines 160 and 161, and longitudinal score lines 156 and 157, together with score lines 125 and 127, and segments 124*a–c* and 126*a–c* of longitudinal score lines 124 and 126, respectively, delineate removable portions 170, 172, 173, and 175. Two additional longitudinal score lines 155 and 158 extend between transverse score lines 160 and 161 and are parallel to longitudinal score line 124, and 156, 157, and 126. Additional removable portion 171 is defined between segment 124*b* of longitudinal score line 124, segment 160*a* of transverse score line 160, longitudinal score line 155, and segment 161*a* of transverse score line 161. Similarly, removable portion 174 is defined between segments 160*e* and 161*e* of transverse score lines 160 and 161, respectively. Segment 126*b* of longitudinal score line 126, and longitudinal score line 158.

Panels 163–169 define second secondary container 176. Panel 163 is bounded by segment 125*b* of score line 125, segments 156*a* and 157*a* of longitudinal score lines 156 and 157, respectively, and transverse score line 159. Panel 164 is bounded by transverse score line 159, segments 156*b* and 157*b* of longitudinal score lines 156 and 157, respectively, and segment 160*c* of transverse score line 160. Panels 166 and 167 are defined analogously with respective to the appropriate segments of score lines 156 and 157, score line 127, and transverse score line 162. Panels 168 and 169 are defined between longitudinal score lines 155 and 156, and 157 and 158, respectively, and the appropriate segments of transverse score lines 160 and 161, as shown in FIG. 9. Finally, panel 165 is bounded by segments 160*c*, 157*c*, 161*c*, and 156*c*, of the respective score lines 160, 157, 161, and 156.

Secondary container 176 is formed by folding panels 163–169 in a manner analogous that by which primary container 40 of the proceeding embodiment is formed, as shown in FIG. 2.

Figure 10:
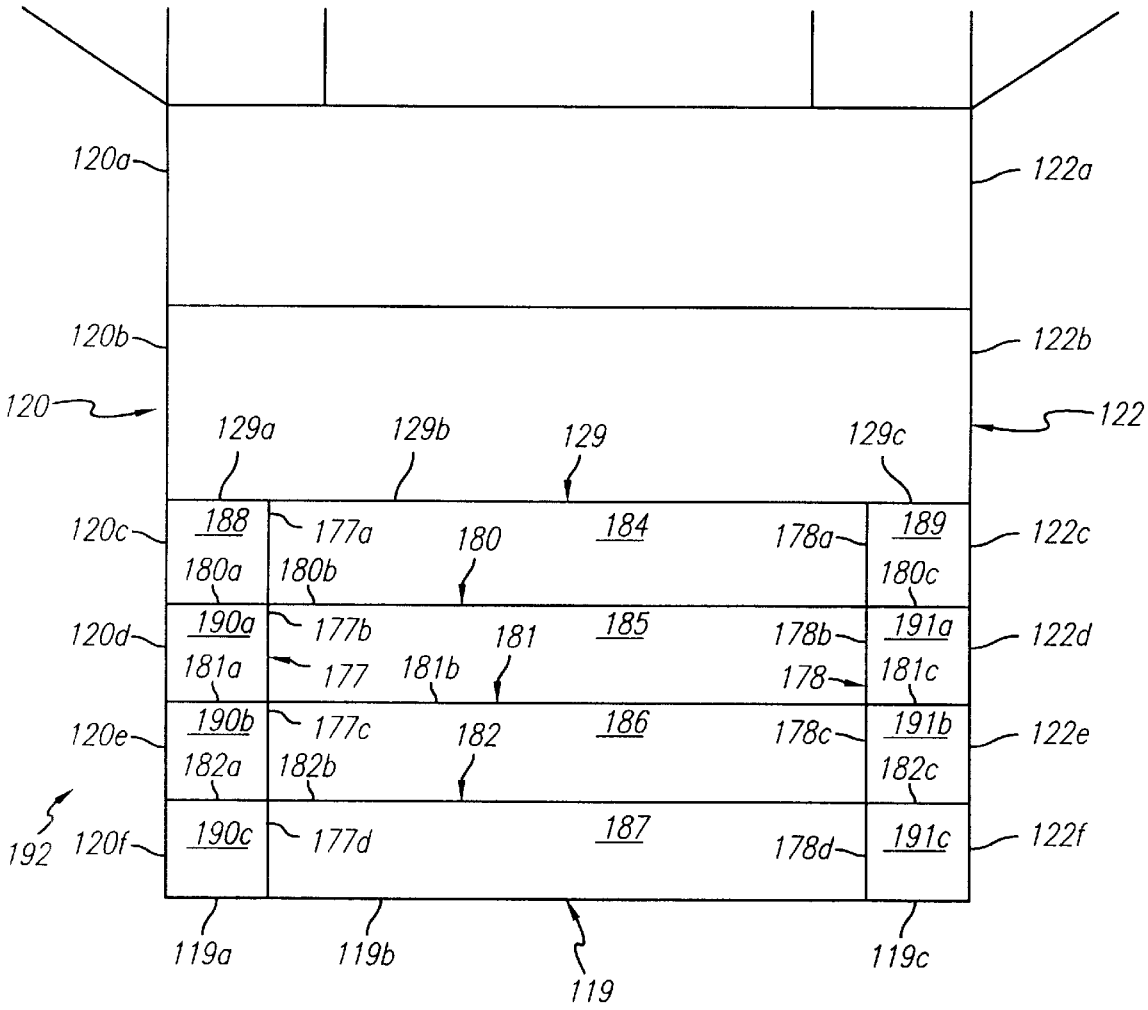
FIG. 10 is a plan view of another portion of the blank of FIG. 7 in which a third second secondary container in the form of a smaller tube is defined.

FIG. 10 illustrates a third secondary container 192 which is formed from one panel (here upper panel 136) of blank 110, rather than from two adjacent panels as with the preceding secondary container 154. Parallel transverse score lines 180, 181, and 182 are defined within upper panel 136 of blank 110, as are parallel longitudinal score lines 177 and 178. In a manner analogous to that shown in FIG. 5, panels 184–189 and removable portions 198*a–c* and 191*a–c* are defined by the appropriate segments of the various transverse and longitudinal score lines described above. Secondary container 192 is formed by folding the various panels in a manner similar to that shown in FIG. 6 with respect to secondary container 76 of the preceding embodiment.

What is claimed is:

1. A blank for forming a plurality of containers comprising a sheet of material having (a) a plurality of edges, (b) a first plurality of score lines, said score lines and edges defining a first plurality of panels, said blank being foldable along said first plurality of score lines to define a primary container, wherein said first plurality of score lines further at least partially define at least one removable portion of at least one said panel, whereby said removable portion has no score lines, is to be discarded and is not to be used for forming any containers, and (c) a second plurality of score lines defined within at least one of said first plurality of panels, said at least one panel within which said second plurality of score lines is defined being detachable from the remainder of said blank, said at least one panel being foldable along said second plurality of score lines to define a secondary container.

2. A blank for forming a plurality of containers comprising a sheet of material having (a) a plurality of edges, (b) a first plurality of score lines, said score lines and edges defining a first plurality of panels, said blank being foldable along said first plurality of score lines to define a primary container, and (c) a second plurality of score lines defined within at least one of said first plurality of panels, said at least one panel within which said second plurality of score lines is defined being detachable from the remainder of said blank, said at least one panel being foldable along said second plurality of score lines to define a secondary container, wherein said at least one panel that is detachable from the remainder of said blank is detachable along a score line that is oriented longitudinally with respect to said blank.

3. A blank for forming a plurality of containers comprising a sheet of material having (a) a plurality of edges, (b) a first plurality of score lines, said score lines and edges defining a first plurality of panels, said blank being foldable along said first plurality of score lines to define a primary container, (c) a second plurality of score lines defined within at least one of said first plurality of panels, said at least one panel within which said second plurality of score lines is defined being detachable from the remainder of said blank, said at least one panel being foldable along said second plurality of score lines to define a secondary container, and (d) non-rectangular side panels.

4. A blank for forming a plurality of containers comprising a sheet of material having (a) a plurality of edges, (b) a first plurality of score lines, said score lines and edges defining a first plurality of panels, said blank being foldable along said first plurality of score lines to define a primary container, (c) a second plurality of score lines defined within at least one of said first plurality of panels, said at least one panel within which said second plurality of score lines is defined being detachable from the remainder of said blank, said at least one panel being foldable along said second plurality of score lines to define a secondary container, and (d) side panels comprising edges that meet at non-right angles.

5. A blank for forming a plurality of containers comprising a sheet of material having (a) a plurality of edges, (b) a first plurality of score lines, said score lines and edges defining a first plurality of panels, said blank being foldable along said first plurality of score lines to define a primary container, (c) a second plurality of score lines defined within at least one of said first plurality of panels, said at least one panel within which said second plurality of score lines is defined being detachable from the remainder of said blank, said at least one panel being foldable along said second plurality of score lines to define a first secondary container, and (d) a third plurality of score lines defined within at least one of said first plurality of panels, said at least one panel within which said third plurality of score lines is defined being foldable along said third plurality of score lines to define a second secondary container, wherein said first secondary container is shaped differently from said second secondary container.

6. A blank for forming a plurality of containers comprising a sheet of material having (a) a plurality of edges, (b) a first plurality of score lines, said score lines and at least a portion of said edges defining a first plurality of panels, said blank being foldable along said first plurality of score lines to define a primary container, (c) a second plurality of score lines, said score lines and at least a portion of said edges defining a second plurality of panels, said second plurality of panels being detachable from the remainder of said blank, and being foldable along said second plurality of score lines to define a first secondary container, and (d) a third plurality of score lines, said score lines and at least a portion of said edges defining a third plurality of panels, said third plurality of panels being detachable from the remainder of said blank, and being foldable along said third plurality of score lines to define a second secondary container, and, wherein said first secondary container is shaped differently from said second secondary container.

* * * * *